US009440468B2

(12) United States Patent
Van Den Heuvel

(10) Patent No.: US 9,440,468 B2
(45) Date of Patent: Sep. 13, 2016

(54) METHOD OF MEASURING A WETTING PROPERTY OF A NOZZLE PLATE

(71) Applicant: OCE-TECHNOLOGIES B.V., Venlo (NL)

(72) Inventor: Desie A. C. M. Van Den Heuvel, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/824,810

(22) Filed: Aug. 12, 2015

(65) Prior Publication Data

US 2016/0052314 A1 Feb. 25, 2016

(30) Foreign Application Priority Data

Aug. 20, 2014 (EP) ..... 14181542

(51) Int. Cl.

| | |
|---|---|
| ***B41J 29/38*** | (2006.01) |
| ***B41J 2/16*** | (2006.01) |
| ***B41J 2/165*** | (2006.01) |

(52) U.S. Cl.

CPC ..... *B41J 29/38* (2013.01); *B41J 2/1606* (2013.01); *B41J 2/16508* (2013.01); *B41J 2/16526* (2013.01); *B41J 2/16538* (2013.01)

(58) Field of Classification Search

CPC .... B41J 2/165; B41J 2/1606; B41J 2/16508; B41J 2/16526; B41J 29/38

See application file for complete search history.

(56) References Cited

U.S. PATENT DOCUMENTS

2014/0085377 A1* 3/2014 Takahashi ..... B41J 2/1433 347/33

FOREIGN PATENT DOCUMENTS

| | | | |
|---|---|---|---|
| DE | 10 2011 017 466 | A1 | 10/2012 |
| EP | 0 367 438 | A1 | 5/1990 |
| EP | 0 671 272 | A2 | 9/1995 |

* cited by examiner

*Primary Examiner* — Sarah Al Hashimi

(74) *Attorney, Agent, or Firm* — Birch, Stewart, Kolasch & Birch, LLP

(57) ABSTRACT

A method of measuring a wetting property of a nozzle plate in a droplet expelling device having a number of nozzles formed in the nozzle plate, and an actuator system for expelling a droplet of a liquid from each of the nozzles includes applying an amount of liquid onto a surface of the nozzle plate, capturing a digital image of the nozzle plate with the liquid applied thereon, and analyzing the digital image for determining the wetting property from a distribution of the liquid on the nozzle plate. The amount of liquid is applied onto the nozzle plate by expelling liquid through the nozzle.

10 Claims, 3 Drawing Sheets

METHOD OF MEASURING A WETTING PROPERTY OF A NOZZLE PLATE

The invention relates to a method of measuring a wetting property of a nozzle plate in a droplet expelling device having a number of nozzles formed in the nozzle plate and an actuator system for expelling a droplet of a liquid from each of the nozzles, the method comprising the steps of:

applying an amount of liquid onto a surface of the nozzle plate, observing the nozzle plate with the liquid applied thereon, and determining the wetting property from a distribution of the liquid on the nozzle plate.

A method with the steps indicated above have been described in DE 10 2011 017 466 A1.

The invention is particularly concerned with measuring wetting properties of a nozzle plate in an ink jet print head which is used for expelling ink droplets onto a recording medium. In such a print head, the wetting properties of the nozzle plate have an influence on the print quality because, when the surface of the nozzle plate gets wetted, this may disturb the process of forming and expelling the ink droplets.

Moreover, since the nozzles of an ink jet print head tend to become clogged with dried ink when the print head is not used for a certain time, it is necessary to clean the nozzles from time to time, e.g. by purging them with liquid ink or with a specific cleaning liquid, and then wiping the surface of the nozzle plate clean. However, repeated wiping of the nozzle plate may degrade the wetting properties. It is therefore desirable to measure the wetting properties of the nozzle plate from time to time in order to assure a constant print quality.

Wetting is the ability of a liquid to maintain contact with a solid surface, resulting from intermolecular interactions when the two are brought together. The degree of wetting is also referred to as wettability. Thus, the wetting property, also known as wettability, of a surface refers to the ability of a surface to maintain contact with a liquid. A measure for quantitatively characterizing the wetting property of a surface is the so-called contact angle, i.e. an angle formed between said surface and a liquid/air meniscus of a liquid droplet on that surface. When the contact angle is larger than 90°, the droplet has an approximately globular shape and the surface is considered to be non-wettable. In contrast, when the contact angle is smaller than 90°, the droplet of liquid tends to spread over a larger area and assumes a lens-like shape. In that case, the surface is considered to be wettable.

Preferably, the nozzle plate has a low wettability, i.e. the contact angle is preferably large (>90°). When a fluid, such as ink, is present on a nozzle plate having a low wettability, the fluid may not spread and may stay on a relatively small part of the nozzle plate, which may decrease the risk of jetting problems due to the presence of liquid on the nozzle plate.

In case a fluid is present on a nozzle plate having a high wettability, the fluid may spread and may cover a relatively large part of the nozzle plate, which may increase the risk of jetting problems due to the presence of liquid on the nozzle plate. Therefore, it is preferred that the nozzle plate has a low wettability and that the wetting property of the nozzle plate stays constant over time.

It is an object of the invention to improve the efficiency with which the wetting properties of a nozzle plate in a droplet expelling device of the type indicated above can be measured.

In order to achieve this object, the method according to the invention is characterized in that the amount of liquid is applied onto the nozzle plate by expelling liquid through the nozzle.

Thus, according to the invention, no specific applicator device is necessary for applying the liquid onto the surface of the nozzle plate. Instead, the liquid is applied by means of pressurizing means present in the ink jet printing system, for example the actuator system that is normally used for expelling the droplets or pressurizing means present in the ink reservoir. By pressuring liquid that is in fluid communication with the nozzle, an amount of liquid may be expelled through the nozzle. Thus, liquid present in the ink jet print head may be used for determining the condition of the nozzle plate.

When liquid is applied onto the nozzle plate though the nozzle, then the liquid may contact the nozzle plate and stay attached to the nozzle orifice and the surrounding surface of the nozzle plate, the surface of the nozzle plate may become wetted to a smaller or larger extent, and minute droplets of the liquid will remain on that surface while the bulk of the liquid is sucked back.

According to the invention, this effect is used for applying liquid onto the surface of the nozzle plate, so that, by capturing a digital image of the nozzle plate and then analyzing this image, it is possible to determine the wetting properties of the nozzle plate from the shape and distribution of the liquid left on the nozzle plate.

It is an additional advantage of this method that the process of applying liquid is targeted to the very area of the surface of the nozzle plate where the wetting properties are of particular importance, i.e. the area surrounding the nozzle orifices.

The step of observing the nozzle plate with the liquid applied thereon may be performed using a camera, such as a digital camera. Alternatively, the nozzle plate may be visually inspected by an operator.

The step of determining the wetting property from a distribution of the liquid on the nozzle plate may be performed based on the observation of the nozzle plate with the liquid applied thereon. This step may be performed by an operator, for example based on his/her observations of the nozzle plate with the liquid applied thereon or based on a picture of the nozzle plate with the liquid applied thereon. Alternatively, the step of determining the wetting property from a distribution of the liquid on the nozzle plate may be performed in an automated way, for example by analysing an image of the nozzle plate with the liquid applied thereon using a computer.

The nozzle plate is observed at least once. Preferably, the nozzle plate may be observed at two (or more) points in time. Alternatively, the nozzle plate may be observed during a certain time interval. In both cases, an optional flow of ink on the nozzle plate may be observed. Such flow of ink may provide additional information regarding the wetting property of the nozzle plate.

In an embodiment, the amount of liquid applied onto the surface of the nozzle plate is a predetermined amount of fluid. By controlling the amount of fluid that is applied onto the surface of the nozzle plate it may be easier to compare the distribution of the liquid on the nozzle plate with a previously observed distribution of the liquid on the nozzle plate and hence, it may be easier to determine the wetting property of the nozzle plate.

In an embodiment, the liquid is expelled by energizing the actuator system with an energy that is insufficient for expelling a droplet. In normal operation of the droplet expelling device, the actuator system is energized to excite, in the liquid, a pressure wave the energy of which is sufficient for forming a droplet in the nozzle orifice and giving the droplet such a momentum that it is expelled from the surface of the nozzle plate. When the energy of the actuator is reduced, the droplet will not have enough momentum to leave the nozzle plate but will be sucked back into the nozzle orifice. However, in the short instant in which a droplet is formed but keeps attached to the nozzle orifice and the surrounding surface of the nozzle plate, the surface of the nozzle plate may become wetted to a smaller or larger extent, and minute droplets of the liquid will remain on that surface while the bulk of the liquid is sucked back.

In an alternative embodiment, each one of the number of pressure chambers is in communication with an ink reservoir, the ink reservoir being provided with pressurizing means for providing a pressure pulse to said ink reservoir, wherein the liquid is expelled by providing a pressure pulse to the ink reservoir.

The fluid chamber of the print head may be in fluid communication with an ink reservoir. The ink reservoir may contain a volume of ink. Optionally, a plurality of fluid chambers may be in communication with one ink reservoir. The ink reservoir may be formed in the inkjet print head. Alternatively, the ink reservoir may be positioned away from the print head and the ink may be supplied from the reservoir to the print head, e.g. via tubing. The ink reservoir may be provided with pressuring means for providing a pressure pulse to said ink reservoir. By pressurizing the pressurizing means, an amount of liquid, e.g. ink may be supplied from the ink reservoir towards the fluid chamber. Depending on the magnitude of the pressure pulse, a certain volume of ink may be provided to the nozzles via the fluid chamber. Preferably, the pressure pulse is such that an amount of liquid is supplied to the nozzle plate via the nozzle, without polluting the inkjet system.

In an embodiment, the droplet expelling device is an ink jet print head.

In a further embodiment, the liquid that is applied to the surface of the nozzle plate is ink.

In an embodiment, the print head is moved from an operating position, where it is used for printing an image, to a cleaning station, and the amount of liquid is applied onto the surface of the nozzle plate while the print head is in the cleaning station.

In an embodiment, the nozzle plate is observed by capturing a digital image of the nozzle plate with the liquid applied thereon, and the wetting property is determined by analyzing the digital image.

In a further embodiment, the print head is moved from the cleaning station to a position of the camera for capturing the digital image after the liquid has been applied.

In an aspect of the invention, an ink jet printer is provided, the ink jet printer having a print head with a nozzle plate and a number of nozzles formed therein, and an actuator system for expelling droplets of ink from each of the nozzles, the printer further having a control system and a camera arranged to capture an image of the nozzle plate, characterized in that the control system is configured to perform the method according to the present invention. The ink jet printer is thus configured to perform the method according to an embodiment of the present invention.

In an embodiment, a cleaning station for cleaning the nozzle plate is disposed between the camera and a media transport system.

An embodiment example will now be described in conjunction with the drawings, wherein.

Figure 1:
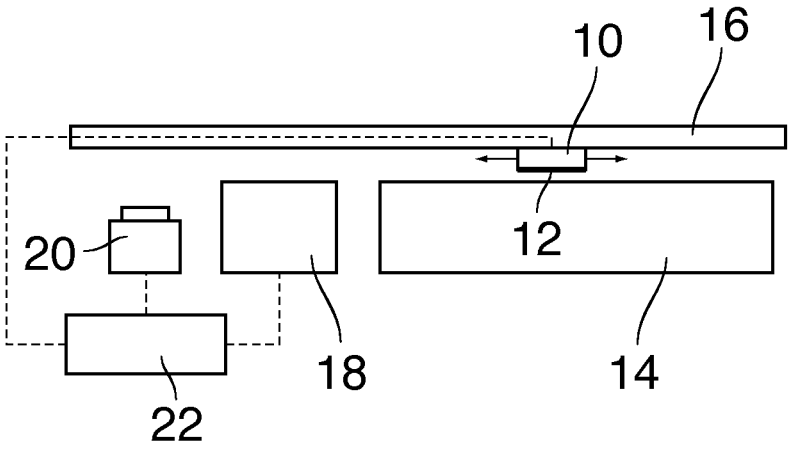
FIG. 1 is a block diagram of an ink jet printer to which the invention is applicable.
Figure 2:
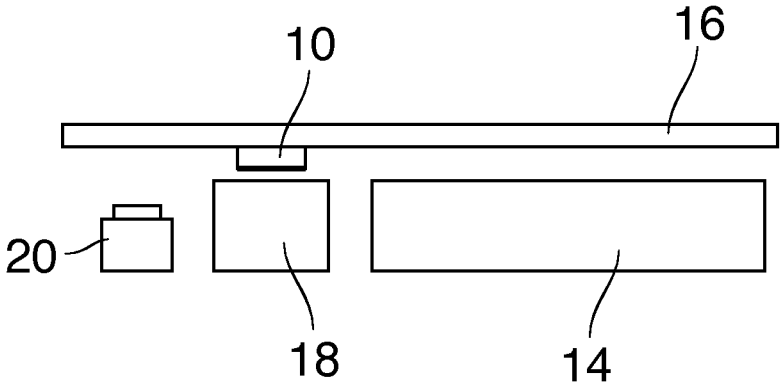
FIGS. 2 and 3 are diagrams illustrating different operating conditions of the printer shown in FIG. 1.
Figure 3:
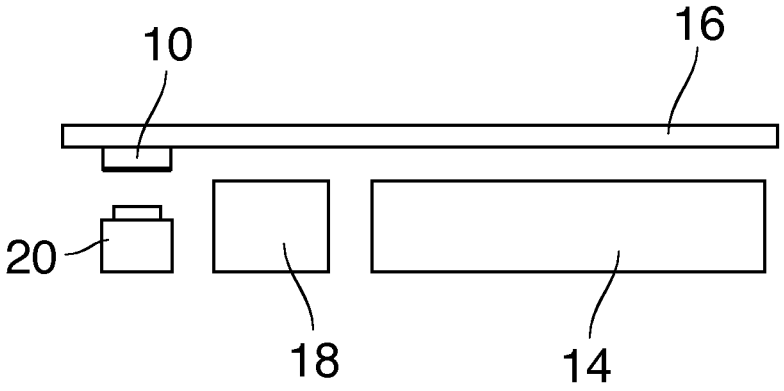

As is shown in FIG. 1, an ink jet printer comprises a print head 10 with a nozzle plate 12 that faces downwardly towards a media conveying system 14 on which sheet like recording media may be moved past the print head 12 in the direction normal to the plane of the drawing.

The print head 10 is movable along a guide rail 16 that extends normal to the direction of transport of the media sheets, as has been indicated by arrows in FIG. 1. For example, the print head (10) may be driven by a drive system (not shown) to move back and forth across the media transport system 14.

A cleaning station 18 is disposed on one side of the media transport system 14, and a digital camera 20 is disposed on the side of the cleaning station 18 opposite to the media transport system 14.

FIG. 1 schematically shows a control system 22 controlling the operation of the print head 10 and its drive system as well as the operation of the cleaning station 18 and the digital camera 20. Further, the control system 22 includes image processing software for processing digital images captured by the camera 20.

FIG. 1 illustrates the normal operating state of the printer, wherein the print head 10 is held stationary or is moved above the media transport system 14 and is controlled to expel ink droplets from nozzles that are formed in the nozzle plate 12 so as to create an image on a recording media sheet.

From time to time, it is necessary to clean the nozzles of the print head 10, e.g. by purging the nozzles with liquid ink. To that end, the print head 10 is moved to the position of the cleaning station 18 which is arranged to collect the ink that has been used for purging the nozzles.

As is generally known in the art, the cleaning station 18 may include a wiping mechanism arranged to wipe the surface of the nozzle plate 12 when the purging process has been completed. Once the nozzle plate 12 has been cleaned in this way, the print head may again be moved back to the position above the media transport system 14, and the print process may be resumed.

In the course of time, especially when frequent wiping operations have been performed in the cleaning station 18, the nozzle plate 12 may be subject to aging, with the consequence that the wetting properties of the nozzle plate are degraded. The camera 20 is provided for measuring the wetting properties of the nozzle plate 12 in certain time intervals which are typically larger than the time intervals in which the print head 10 is cleaned in the cleaning station.

When it is desired to measure the wetting properties of the nozzle plate, the print head 10 is kept above the cleaning station 18 and is controlled to perform a so called micro-purge operation. In such a micro-purge, the actuators in the print head 10 that are normally used for expelling ink droplets in printing operation or for purging the nozzles in the cleaning station, are excited with a reduced energy that is not sufficient for expelling ink droplet but still causes a certain amount of liquid (i.e. ink in this example) to be squeezed out of each nozzle. Most of this ink will be sucked back into the nozzle immediately after the purging pulse has ended, but a small amount of liquid will remain on the surface of the nozzle plate surrounding the nozzle orifices. The print head 10 will then be moved to the position of the camera 20 while capillary forces cause the liquid on the surface of the nozzle plate to assume a configuration that is characteristic for the current wetting properties of the nozzle plate, as will be explained in greater detail below. Then, an image is captured with the camera 20, and the image processing software in the control system 22 analyses the digital image to determine the wetting properties of the nozzle plate.

Finally, the print head 10 is moved back into the position above the cleaning station 18 where the nozzle plate may be wiped clean, and then the printing operation may be resumed.

Figure 4:
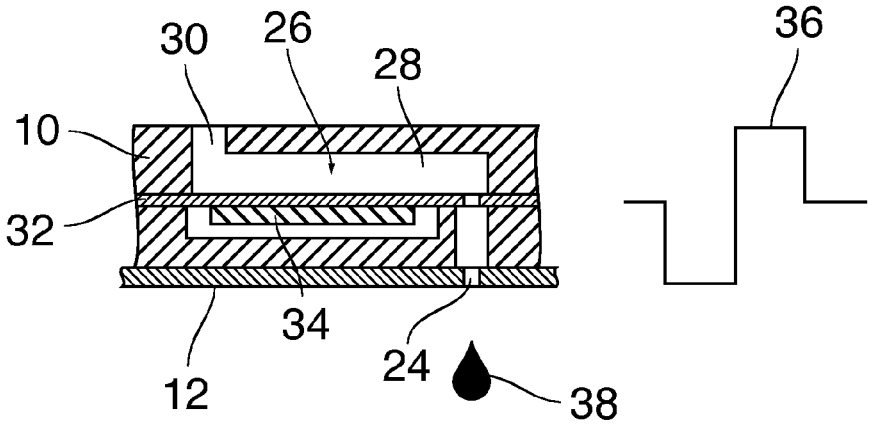
FIG. 4 is a cross-sectional view of an individual droplet expelling device in the printer shown in FIG. 1, illustrating a droplet expelling mode of operation.

FIG. 4 is a cross-sectional view of a part of the print head 10, showing a single nozzle 24 formed in the nozzle plate 12 as well as an actuator system 26 associated with the nozzle 24. The actuator system 26 comprises a pressure chamber 28 that communicates on one side with an ink supply line 30 and on the opposite side with the nozzle 24. A bottom wall of the pressure chamber 28 is formed by a flexible membrane 32, and a piezoelectric actuator 34 is attached to the bottom face of the membrane 32 on the side outside of the pressure chamber 28.

In the example shown, the actuator 34 is a piezoelectric actuator. FIG. 4 also shows a wave form 36 of a voltage signal that is applied to the piezoelectric actuator 34. When an ink droplet 38 is to be expelled from the nozzle 24, first, a negative pulse of the wave form 36 causes the actuator 34 to deform in a bending mode, forcing the membrane 32 to bulge downwardly, so that liquid ink is sucked-in from the supply line 30. The supply line 30 is in fluid communication with the ink reservoir (not shown). Then, a positive pulse of the wave form 36 causes the membrane 32 to flex upwardly into the pressure chamber 28, thereby creating a positive pressure wave that will propagate towards the nozzle 24 and cause a droplet 38 to be created in the nozzle orifice and to impart to that droplet a momentum sufficient for overcoming the adhesive forces of the nozzle plate 12 and jetting the droplet 38 out downwardly towards the recording medium or towards the cleaning station 18 in case of a full-purge operation.

Figure 5:
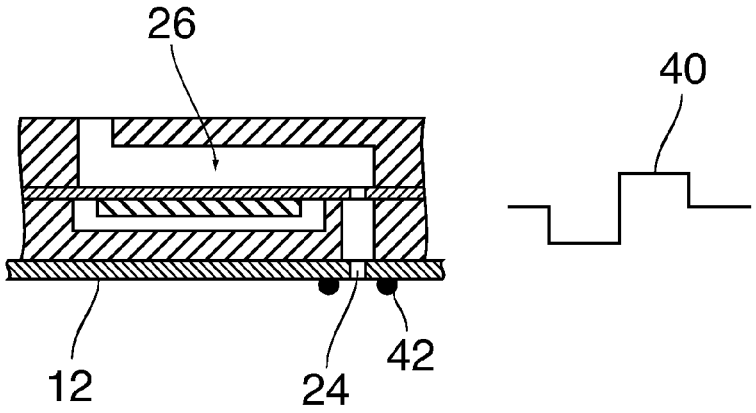
FIGS. 5 and 6 are cross-sectional views illustrating a liquid applying mode of operation of the droplet expelling device for different wetting properties of a nozzle plate.

FIG. 5 shows a wave form 40 that is applied to the actuator 34 in case of a micro-purge operation. Again, the wave form includes a negative pulse followed by a positive pulse, but the amplitudes of both pulses are lower than in the full-purge case. As a consequence, the momentum of an ink droplet forming in the orifice of the nozzle 24 is not sufficient for causing the droplet to leave the nozzle. Instead, when the voltage applied to the actuator drops to its normal level and the membrane 32 flexes back into the flat state shown in FIG. 5, most of the ink of the ink droplet is sucked back into the nozzle 24. However minor remnants of ink tend to remain on the surface of the nozzle plate 12 that surrounds the nozzle orifice. FIG. 5 illustrates the case where the (bottom) surface of the nozzle plate 12 is non-wetting, i.e. the cohesion of the liquid ink is larger than the adhesive forces between the liquid ink and the surface of the nozzle plate. As a consequence, the cohesive forces cause the remnants of ink to accumulate into minute, essentially globular droplets 42, as has been shown exaggeratedly in FIG. 5.

Figure 6:
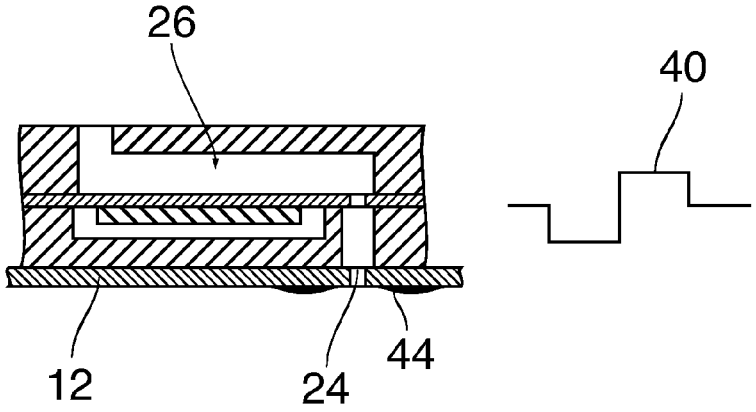

FIG. 6 illustrates the effect of the micro-purge operation for the case that, due to aging, the nozzle plate 12 has become wetting. In this case, the adhesive forces between the nozzle plate and the liquid ink prevail and force the remnants of ink to spread-out into shallow, lens-shaped "puddles" 44.

Figure 7:
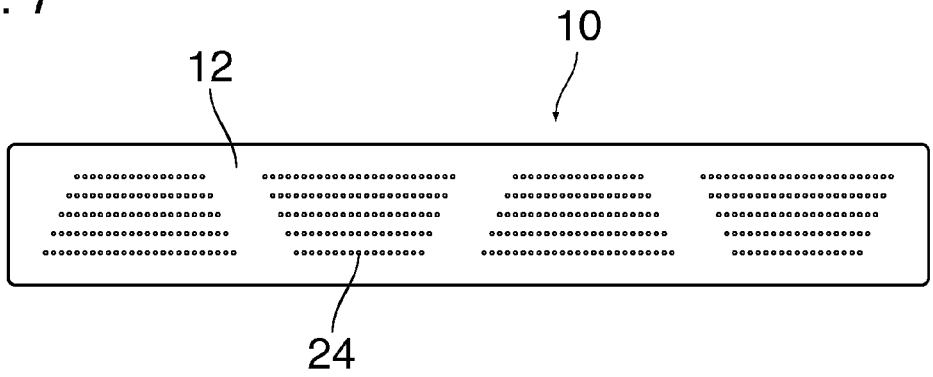
FIG. 7 is a front view of the nozzle plate in a condition before liquid is applied thereto.

FIG. 7 shows a front view of the nozzle plate 12 of the print head 10. As can be seen, the nozzle plate has a relatively large number of nozzles 24 arranged in an array that is constituted by several parallel rows. FIG. 7 shows the nozzle plate 12 in a clean condition with no ink being applied thereon.

Figure 8:
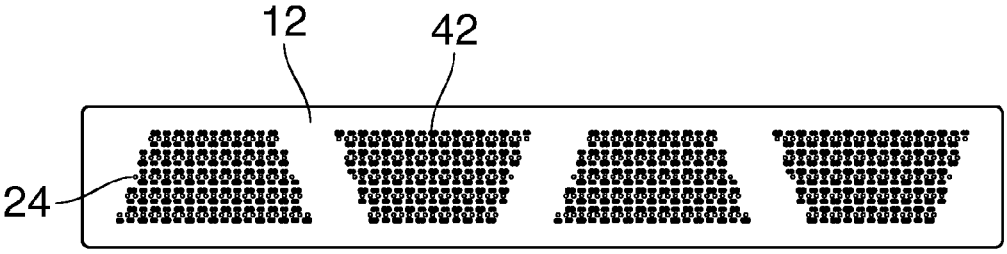
FIG. 8 is a front view of the nozzle plate in a condition in which liquid is applied thereon and the surface of the nozzle plate is essentially non-wettable.

FIG. 8 shows a digital image of the nozzle plate 12 as captured with the camera 20 after a micro-purge operation performed with all the nozzles 24 and under a non-wetting condition of the nozzle plate. As can be seen, the ink that has been applied in the micro-purge has accumulated into the minute droplets 42 most of which are isolated from one another. In the area immediately adjacent to the rows of nozzles 24, the ink has been sucked back into the nozzles, so that the minute droplets 42 generally constitute a pattern of rows of dots that extend in parallel with the rows of nozzles 24.

Figure 9:
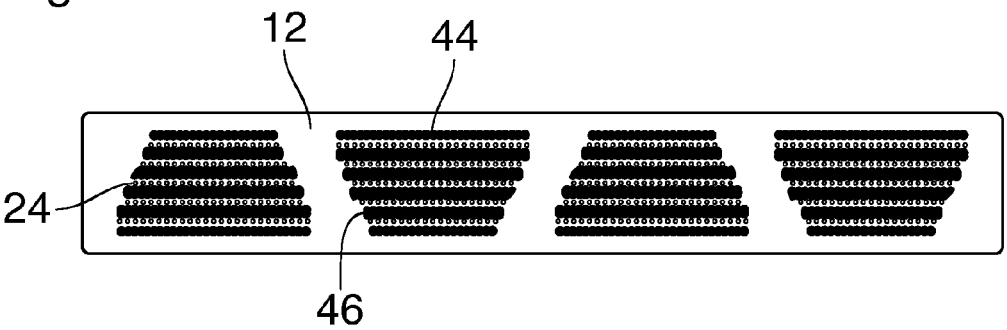
FIG. 9 is a front view of the nozzle plate with liquid applied thereon, illustrating the case where the nozzle plate is essentially wettable.

For comparison, FIG. 9 illustrates a digital image that would be obtained in case of a wetting nozzle plate 12. In this case, the ink has a spread-out in the form of the puddles 44, with ink puddles that have resulted from adjacent nozzles merging into one another so as to form a general pattern of continuous bands that extend in parallel with the rows of nozzles. In the spaces between two adjacent nozzle rows, the bands of ink flanking the nozzles have also merged into one another and formed a single band 46 with a relative large width.

Thus, the distributions of ink that are obtained for a non-wetting nozzle plate 12 (FIG. 8) on the one hand and for a wetting nozzle plate (FIG. 9) on the other hand, have characteristic features that make them distinguishable from one another. Thus, image processing software may easily be programmed for calculating a good estimate for the wetting properties (e.g. in terms of a contact angle) of the nozzle plate on the basis of the digital image. For example, the software may count the average length in the direction of the nozzle rows of non-interrupted areas that are covered with ink. In an alternative example, the software may determine the volume of ink present on the nozzle plate. Optionally, a neural network might be trained for determining the wetting properties.

As the distribution of the ink on the nozzle plate 20 may vary in the course of time under the action of adhesive and cohesive forces and also because of evaporation of solvent from the ink and/or curing of the ink, it is preferable that the digital images are always captured after a fixed time interval has passed since the micro-purge.

Preferably, the micro-purge is performed while the print head is still above the cleaning station 18, so that, if any ink should escape from the nozzle plate 12, it will not stain the optical system of the camera 20 and will not contaminate recording media or the media transport system.

When, by analyzing the digital image of the nozzle plate, it has been found that the wetting properties are no longer satisfactory, a signal may be displayed to the user, indicating that the print head or at least the nozzle plate should be exchanged or a suitable surface treatment should be applied in order to restore the desired wetting properties of the nozzle plate.

The invention claimed is:

1. A method of measuring a wetting property of a nozzle plate in a droplet expelling device having a number of nozzles formed in the nozzle plate, each one of the nozzles being in fluid communication with a pressure chamber, and an actuator system for expelling a droplet of a liquid from each of the nozzles, the method comprising the steps of:

applying an amount of liquid onto a surface of the nozzle plate;

observing the nozzle plate with the liquid applied thereon; and determining the wetting property from a distribution of the liquid on the nozzle plate, wherein the amount of liquid is applied onto the nozzle plate by expelling liquid through the nozzle, and wherein the liquid is expelled by energizing the actuator system with an energy that is insufficient for expelling a droplet.

2. The method according to claim 1, wherein each one of the number of pressure chambers is in communication with an ink reservoir, the ink reservoir being provided with pressurizing means for providing a pressure pulse to said ink reservoir, wherein the liquid is expelled by providing a pressure pulse to the ink reservoir.

3. The method according to claim 1, wherein the droplet expelling device is an ink jet print head.

4. The method according to claim 1, wherein the liquid that is applied to the surface of the nozzle plate is ink.

5. The method according to claim 1, wherein the print head is moved from an operating position, where it is used for printing an image, to a cleaning station, and the amount of liquid is applied onto the surface of the nozzle plate while the print head is in the cleaning station.

6. A method of measuring a wetting property of a nozzle plate in a droplet expelling device having a number of nozzles formed in the nozzle plate, each one of the nozzles being in fluid communication with a pressure chamber, and an actuator system for expelling a droplet of a liquid from each of the nozzles, the method comprising the steps of:

applying an amount of liquid onto a surface of the nozzle plate;

observing the nozzle plate with the liquid applied thereon; and determining the wetting property from a distribution of the liquid on the nozzle plate, wherein the amount of liquid is applied onto the nozzle plate by expelling liquid through the nozzle, wherein the nozzle plate is observed by capturing a digital image of the nozzle plate with the liquid applied thereon, and wherein the wetting property is determined by analyzing the digital image.

7. The method according to claim 6, wherein the print head is moved from the cleaning station to a position of a camera for capturing the digital image after the liquid has been applied.

8. An ink jet printer having a print head with a nozzle plate and a number of nozzles formed therein, each one of the nozzles being in fluid communication with a pressure chamber and an actuator system for expelling droplets of ink from each of the nozzles, the printer further having a control system and a camera arranged to capture an image of the nozzle plate, wherein the control system is configured to perform the method according to claim 4.

9. The printer according to claim 8, wherein each one of the number of pressure chambers is in communication with an ink reservoir, the ink reservoir being provided with pressurizing means for providing a pressure pulse to said ink reservoir.

10. The printer according to claim 8, wherein a cleaning station for cleaning the nozzle plate is disposed between the camera and a media transport system.

* * * * *